US005237848A

United States Patent [19]

Campbell

[11] Patent Number: 5,237,848

[45] Date of Patent: Aug. 24, 1993

[54] METHOD AND APPARATUS FOR EXPANDING AND CONTOURING HONEYCOMB CORE

[75] Inventor: Kenneth L. Campbell, Yucaipa, Calif.

[73] Assignee: Rohr, Inc., Chula Vista, Calif.

[21] Appl. No.: 812,031

[22] Filed: Dec. 23, 1991

[51] Int. Cl.[5] ..... B21D 31/04; B21D 11/02

[52] U.S. Cl. ..... 72/296; 72/151; 72/183; 72/303; 72/406; 29/6.1

[58] Field of Search ..... 72/302, 303, 297, 296, 72/151, 406, 149, 183, 199; 29/6.1, 6.2

[56] References Cited

U.S. PATENT DOCUMENTS

| | | | |
|---|---|---|---|
| 974,288 | 11/1910 | McCarroll | 72/406 |
| 1,910,832 | 5/1933 | Henderson | 72/406 |
| 2,633,893 | 4/1953 | Philippi | 72/183 |
| 3,478,553 | 11/1969 | Weglarz | 72/296 |
| 3,545,242 | 12/1970 | Dean | 72/151 |
| 3,879,994 | 4/1975 | Hume | 72/406 |
| 4,187,711 | 2/1980 | Lavochkin | 72/303 |
| 4,893,391 | 1/1990 | Zobel | 72/296 |

*Primary Examiner*—Daniel C. Crane

*Attorney, Agent, or Firm*—Patrick J. Schlesinger; Frank D. Gilliam

[57] ABSTRACT

A method and apparatus for expanding and contouring honeycomb preforms into compound curved honeycomb core sheets. Honeycomb preforms are provided having a plurality of face to face, contiguous, strips bonded together at selected narrow areas such that when strips along opposite edges are moved away from each other a sheet having a repeating array of regular hexagonal cells results. Opposite edge strips are secured to two spaced arms located adjacent to a freely rotatable crowned drum having a surface contour corresponding to the desired honeycomb sheet configuration. One of said arms is pivoted about the drum axis. As the arms are moved apart, a flat partially expanded honeycomb sheet initially develops. As arm movement continues, the sheet then comes into sliding contact with the drum surface. When cell expansion is completed, during the final shaping and setting phase, the honeycomb core sheet is in full contact with the drum surface. The resulting compound curved sheet is removed, trimmed and is ready for further processing, such as bonding face sheets thereto. Very uniform hexagonal cells result with no significant distortion. Non-compound, generally cylindrical expanded honeycomb sheets may be formed by utilizing only a slight drum crown.

15 Claims, 3 Drawing Sheets

METHOD AND APPARATUS FOR EXPANDING AND CONTOURING HONEYCOMB CORE

BACKGROUND OF THE INVENTION

This invention relates in general to the production of expanded metal honeycomb sheet material and, more specifically, to a method and apparatus for expanding and forming contoured metal honeycomb sheets.

Honeycomb core panels have come into widespread use in a variety of applications that require a combination of high strength and light weight. Honeycomb sheets are formed from preforms that basically consist of a large number of narrow strips of metal material, such as aluminum, stacked and bonded together in small spaced areas, such as by adhesive or solder bonding, so that when the outside edge strips are pulled away from each other the preform expands into a sheet having a uniform pattern of a very large number of small hexagonal cells, resembling a honeycomb. Typical of the prior art methods of producing honeycomb core preforms is that described by Hartsell in U.S. Pat. No. 3,077,223. This core is conventionally formed into flat panels by stretching strips on opposite sides away from each other, as described by Steele et al in U.S. Pat. No. 2,674,295.

When face sheets, such as thin aluminum sheets, are bonded to the faces of the honeycomb core, a panel with a very high strength to weight ratio results.

These honeycomb core panels are widely used in flat or cylindrical shapes for a variety of purposes. In some cases, complex curved shapes are required. For example, in aircraft engine casings or nacelles, fuselage panels, and other aerospace applications shapes, such as simple curves and compound curves, which are basically crowned cylindrical shapes are often required.

In the past, such shapes have generally been formed by pulling a honeycomb preform into an expanded flat sheet or plank. The fully expanded sheet is then roll formed by passing the sheet through a series of forming rollers. Typical of this system is that disclosed by Curran in U.S. Pat. No. 4,054,477. This method is generally suitable only for contouring the sheet in one direction. Unfortunately, this method often mutilates or distorts cells and areas of the sheet surface, so that generally only about 50% of the shaped honeycomb sheets are acceptable for use. Attempts to roll form in two directions generally result in unacceptable cell damage. Curved honeycomb core can also be formed by stretch forming the honeycomb core or on a fixed cylindrical curved surface as shown by Chester et al in U.S. Pat. No. 3,788,117. Since stretch forming often will severely distort the honeycomb cells through compression on the concave side of the core, Chester et al attempt to assure that the entire panel thickness is stretched, avoiding compression of the inner surface. This method is not capable of forming crowned curved surfaces and may cause severe distortion if the panel does not slip uniformly on the forming surface. Panels having a honeycomb core bonded to two face sheets have been formed into complex curved shapes by hydraulic methods, such as described by Fuchs in U.S. Pat. No. 3,373,460. This method can severely distort or crush the honeycomb core, as seen in Fuchs, FIG. 3, and is not suitable for shaping of honeycomb core sheets alone, since the face sheets are necessary to provide a surface to react the hydraulic forces.

Thus, there is a continuing need for methods of forming metal honeycomb sheets into simple and complex curved shapes without damage to the honeycomb cells.

SUMMARY OF THE INVENTION

It is, therefore, an object of this invention to provide an apparatus and method for expanding and contouring metal honeycomb sheets that overcome the above-noted problems. Another object is to provide an apparatus and method that can uniformly produce contoured honeycomb sheets without damaging the fully formed honeycomb cells. A further object is to provide an apparatus and method that is capable of producing a variety of high quality crowned cylindrical honeycomb sheet shapes.

The above objects, and others, are accomplished in accordance with this invention by an apparatus and method that initially expands a honeycomb preform to a selected percentage of the final expansion, preferably from about 50 to 80%, then gradually brings the preform into gradually increasing sliding engagement with a crowned, freely rotatable, generally cylindrical, surface during further expansion, typically 10 to 30% of full expansion, and finally completes expansion, typically about 10–15% of full expansion with the honeycomb in full contact with the forming surface to set the final compound contour.

In some cases, a cylindrical, non-compound curved, expanded honeycomb sheet is desired. If the preform is expanded around a simple cylindrical drum, the product will be bowed slightly toward the inside of the cylinder. To form a precise cylindrical expanded honeycomb product, the method and apparatus of the invention are used with a suitably slightly crowned drum.

The basic apparatus includes a supporting structure on which a drum is mounted for unrestricted, free, rotation. The surface of the drum is crowned in a desired shape to provide a predetermined tool surface, which is a surface of rotation, to produce the desired honeycomb sheet compound contour. A fixed arm assembly includes a bar positioned adjacent to the drum surface. A second arm assembly is mounted so as to pivot about the drum axis with a second bar positioned adjacent to the drum surface. A honeycomb preform is secured between the fixed and movable bars by suitable connection means, such as wire loops, extending from each bar around the adjacent edge strip of the preform.

In operation, the movable bar is moved away from the fixed bar to begin expanding the honeycomb. Initially, the preform does not contact the drum surface, so that the expanding honeycomb is initially essentially flat. Eventually, at a selected point in the expansion, the expanding sheet begins to contact the surface of the drum. Preferably, this contact begins after the preform has expanded from about 50 to 80% of full expansion. The honeycomb slides on the drum surface as further expansion brings more of the honeycomb into contact with the drum surface during a further expansion of about 10 to 30% of full expansion. The drum is completely free to rotate in response to friction forces between expanding honeycomb sheet and drum to accommodate expansion without "catching" cells on the drum surface and distorting the cells in a sliding contact that may involve a slight rotation of the drum. Finally, during the final expansion of about 10–15% of the total expansion, the honeycomb sheet is in full contact with the drum to set the final cell size and sheet compound contour. The connections between the arm assemblies and the sheet are then removed and the sheet is ready for further panel assembly processes.

During this expansion and forming operation it is desirable for the honeycomb sheet to contact less than about 30% of the circumference of the drum. Greater contact may undesirably over expand and deform the end portions of the honeycomb sheet.

If desired, both of the arms could be pivoted about the drum axis and movable away from each other, although the use of one fixed and one movable arm is preferred for simplicity and effectiveness. A variety of different connection means could be used between the arm assembly bars and the preform, including wires, openable rings, clamps and the like.

The drum may have any suitable surface material. The surface material coefficient of friction is selected to provide a suitable resistance to sliding depending on the material from which the honeycomb is made. In general, the lowest possible resistance to sliding is preferred. A hard surface in relation to the hardness of the honeycomb core material is preferred. The surface should be very smooth. Typical surface materials include stainless steel cloth, fiberglass or graphite composite material, steel, stainless steel and other hard materials with low friction surface coatings. With aluminum honeycomb core, materials exhibiting smoothness, high hardness relative to aluminum, low sliding friction and durability are preferred.

BRIEF DESCRIPTION OF THE DRAWINGS

Details of the invention, and of certain preferred embodiments thereof, will be further understood upon reference to the drawings, wherein.

DETAILED DESCRIPTION OF PREFERRED EMBODIMENT

Figure 1:
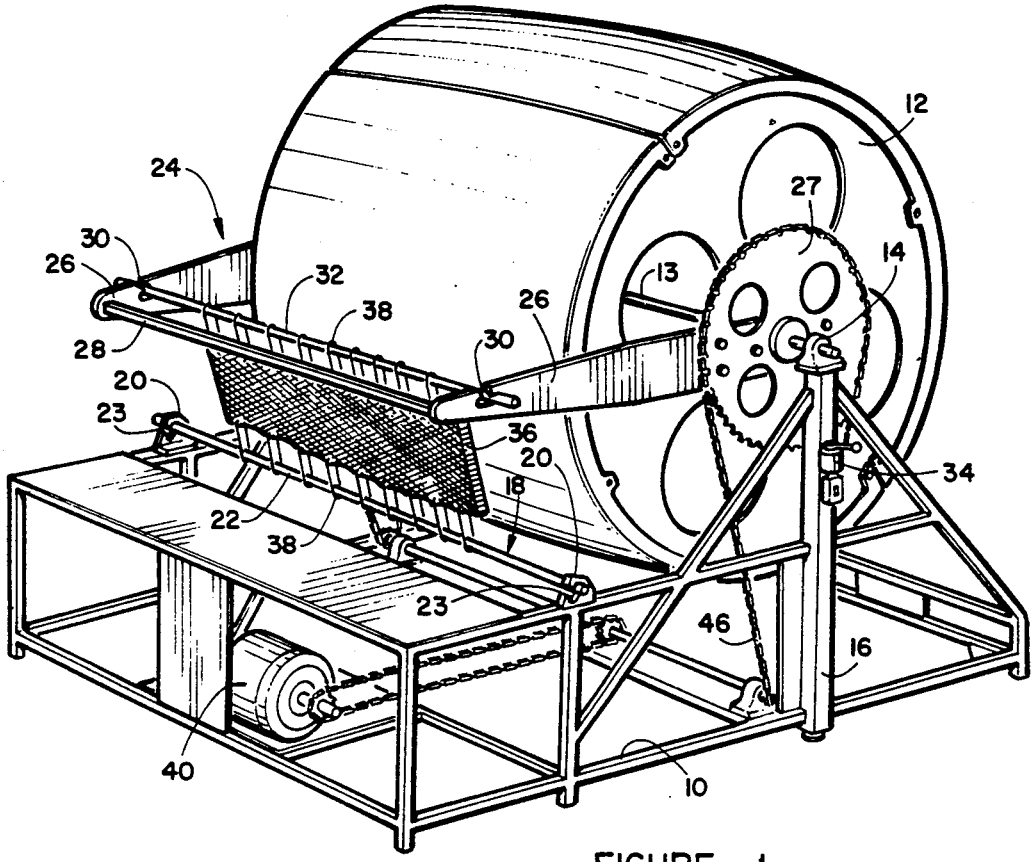
FIG. 1 is a perspective view of the preferred apparatus of this invention at the start of expansion.
Figure 6:
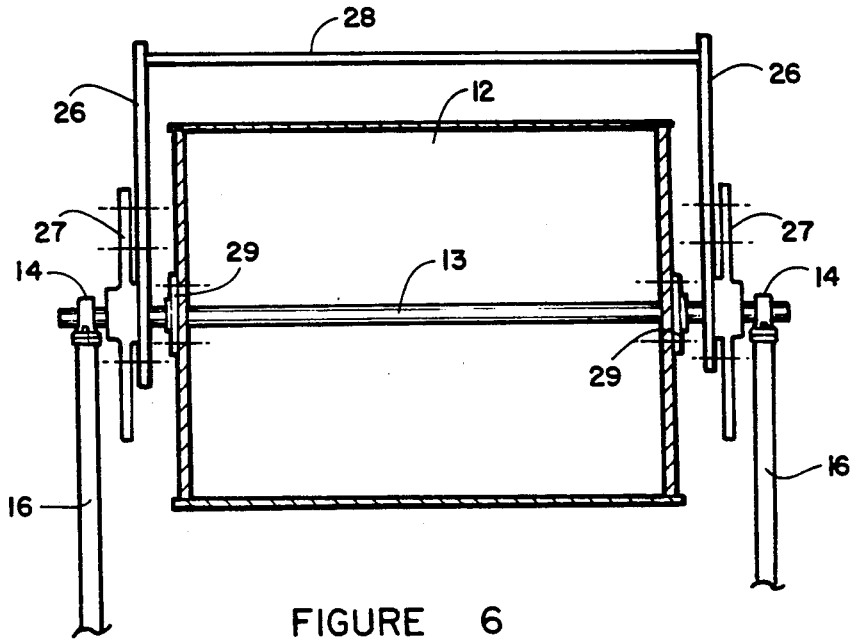
FIG. 6 is a schematic elevation view showing the movable arm, drum and frame attachment.

Referring now to FIG. 1, there is seen a support structure or base 10. A drum 12 is mounted for free, unrestricted, rotation on shaft 13 mounted in bearings 14 mounted at the top of uprights 16 (as best seen in FIG. 6). In FIG. 1, upright 16 on the near side is mostly enclosed within housing 18 that shrouds the arm drive system, as detailed below.

A fixed bar assembly 18 is mounted on support structure 10. The assembly 18 includes a pair of brackets 20 positioned near each end of drum 12 and having a bar 22 running therebetween. Bar 22 is removably located in slots 23 in brackets 20.

A movable bar assembly 24 includes a pair of elongated arms 26 attached to sprocket 27 mounted to shaft 13 at the ends of drum 12 and opening allowing pivotably mounting on shaft 13. Drum 12 attaches to bearing 29 on shaft 13 attached to bearings 14. The other ends of elongated arms 26 are maintained in a spaced apart relationship by a spacer bar 28. Slots 30 at the ends of arms 26 are adapted to support a removable bar 32. A reversible drive system moves moveable arm assembly 24 between the positions shown in FIGS. 3 through 5 under the control of a conventional reversing switch 34.

A suitable honeycomb preform 36 is positioned between fixed bar 22 and movable bar 32. A plurality of wires 38 are threaded through preform strips near the edges of preform 36, around bars 22 or 32, respectively and tied or twisted, as shown. Any other suitable connecting or clamping devices may be used, if desired to flexibly secure the preform edges to the fixed and movable bars 22 and 32 As seen in FIG. 1, the apparatus is ready to begin the honeycomb and expansion and forming operation.

Figure 2:
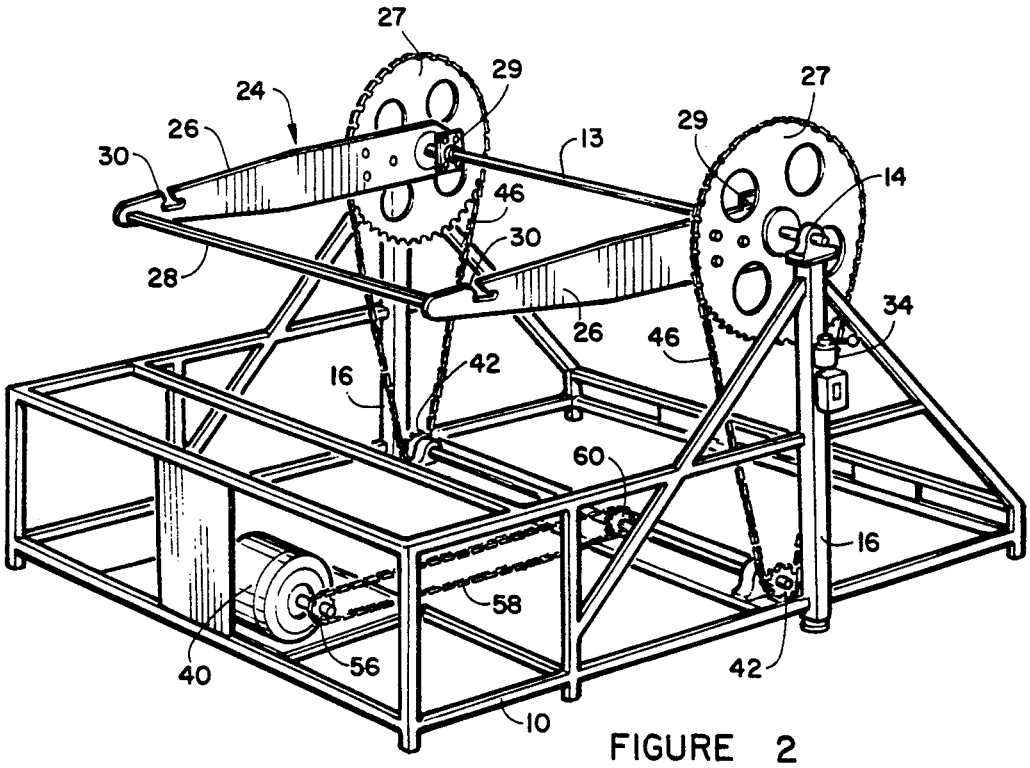
FIG. 2 is a perspective view of the apparatus frame and drive system.
Figure 3:
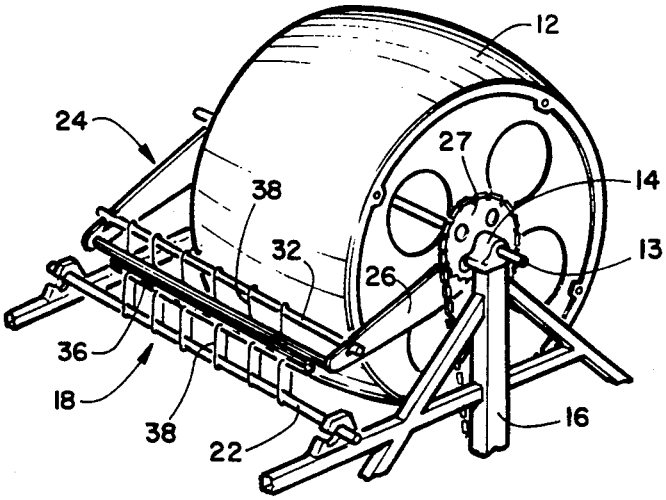
FIG. 3 is a partial perspective view of the apparatus with the honeycomb core loaded, before expansion begins.
Figure 4:
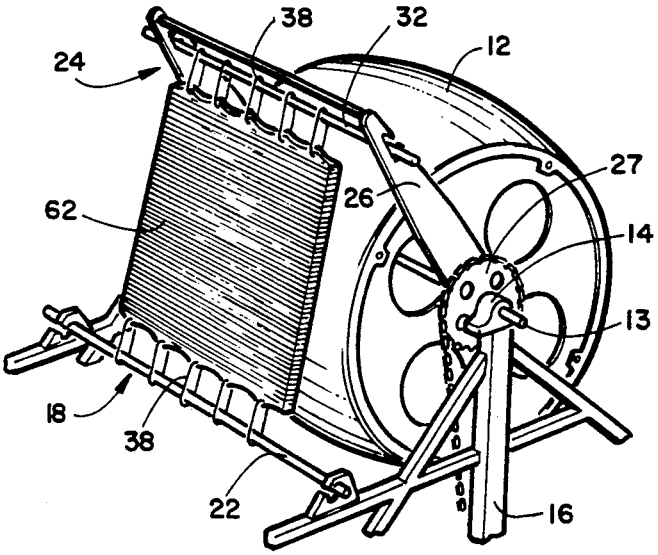
FIG. 4 is a perspective view of the apparatus of FIG. 3 during initial expansion.

FIG. 2 shows the apparatus of FIG. 1 from a slightly different point of view, with the drum 12 removed. As seen in FIGS. 3 and 4, bars 22 and 32 are spaced from the surface of drum 12, as bar 32 is pivoted around drum 12 to initially preform the honeycomb core 36 and to expand it into a flat partially expanded honeycomb sheet as seen in FIG. 4. This initial expansion is preferably about 50 to 80% of full expansion. Eventually, depending on the position selected for fixed bar 22 on brackets 20 and the length of arms 26 and the position selected for arm 32 relative to the surface of drum 12, the partially expanded preform 36 will come into contact with the top of the crowned drum surface.

Thereafter, the preform 36 will engage the drum surface, possibly rotating the drum as it slides over the drum surface. I have found that this combined rotation and sliding action avoids deformation of the expanding honeycomb cells. During this second step, further expansion of the honeycomb core takes place, preferably from about 10 to 30%, as well as initial forming over step it is desirable for the honeycomb sheet to contact less than about 30% of the circumference of the drum. Greater contact may undesirably over expand and deform the end portions of the honeycomb sheet.

Figure 5:
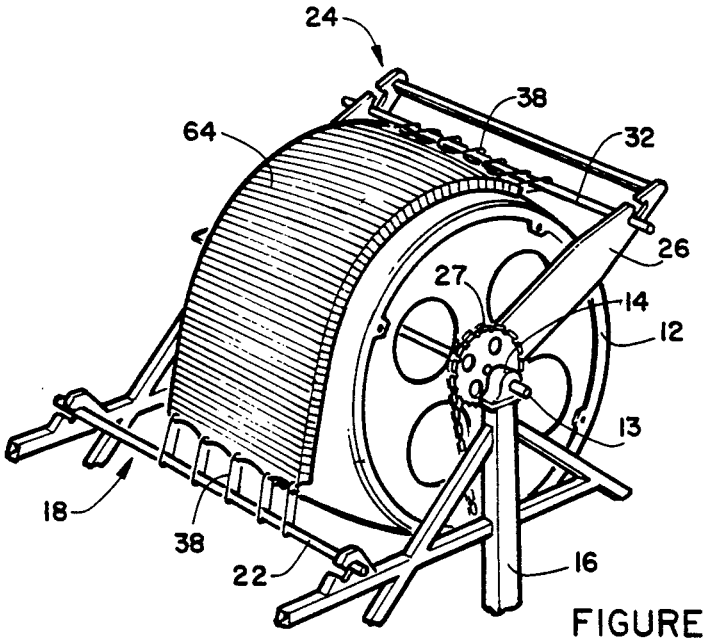
FIG. 5 is a perspective view of the apparatus of FIG. 3 at the completion of expansion and forming.

Eventually, the expanding preform reaches full expansion, as shown in FIG. 5 to fully expand the core and to "set" the final deformation downwardly over the crowned drum 12. the expanded preform 36 is in full contact with the crowned drum surface. Wires 38 can then be removed and the expanded, shaped, honeycomb sheet can be removed. The edges of the sheet are trimmed to the desired dimensions and the sheet is ready for further processing, such as bonding face sheets thereto. Switch 34 is then activated to reverse the drive system to return the movable arm assembly 24 to the position shown in FIGS. 1 and 3.

A conventional reversible electric motor 40 is mounted on support structure 10. Sprockets 42 and 27 are drivingly connected to motor 40 and one of arms 26, respectively. Drive chain 46 runs between sprockets 42 and 27. Sprocket 27 is secured to an arm 26, such as by bolts or rivets. Drum 12 rotates freely about the shaft while the shaft 13, arms 26 and sprockets 27 are fixed to each other and rotate as a unit. Switch 34 (FIGS. 1 and 2) is a conventional reversing switch which selectively causes motor 40 to operate in either direction. Conventional limit switches can be mounted on support structure 10, if desired, to limit movement of arms to travel between the positions of FIGS. 3 and 5.

Figure 7:
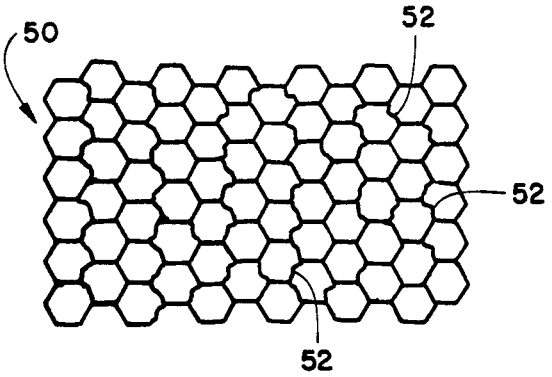
PRIOR ART FIGURE 7
FIG. 7 is plan view of a honeycomb sheet made according to a prior art method.
Figure 8:
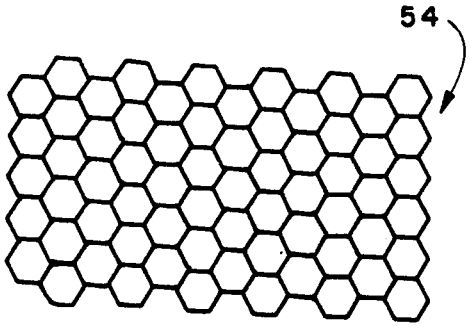
FIG. 8 is a plan view of a honeycomb sheet made by the apparatus and method of this invention.

Examples of typical honeycomb cell structure produced by the forming methods of the prior art and by the method and apparatus of this invention are provided in FIGS. 7 and 8, which are drawings based on photographs of actual honeycomb sheets. As seen in FIG. 7, the prior art roll forming method described above tends to distort the cell pattern of honeycomb 50, showing a number of damaged cells 52. Further, although not readily apparent in this view, the wall edges of the cells are often damaged, so that the cell walls will not meet and bond well to a face sheet which is later applied to the face of the honeycomb core sheet. As seen in FIG. 8, uniform, regular hexagonal honeycomb cells 54 result when the expanded honeycomb sheet is prepared in accordance with this invention.

While certain specific relationships, arrangements and materials were specified in the above description of preferred embodiments, those may be varied, where suitable, with similar results. For example, honeycomb preforms made from a variety of materials may be formed using this method and apparatus, and various coatings, lubricants, etc. could be used on the crowned drum surface to optimize the surface coefficient of friction for specific honeycomb sizes and materials.

Other applications, variations and ramifications of this invention will occur to those skilled in the art upon reading this disclosure. For example, certain arm and bar assemblies may be made to accommodate various application requirements. Those are intended to be included within the scope of this invention, as defined in the appended claims.

I claim:

1. Apparatus for expanding and contouring honeycomb preforms into compound curved honeycomb sheets which comprises:

a supporting structure;

a drum having a crowned surface;

said drum mounted on said supporting structure for free rotation about its axis;

a first arm assembly mounted on said supporting structure adjacent to said drum surface;

first connecting means on said arm assembly adapted to engage and hold outside end strips of a honeycomb preform;

a second, movable, arm assembly mounted on said supporting structure for pivoting movement about said drum axis relative to said free rotation of said drum;

second connection means on said second arm assembly adapted to engage and hold the second, opposite, end strips of said honeycomb preform;

means for rotating said second arm assembly away from said first arm to cause said honeycomb preform to initially expand in a generally flat configuration; and said arm assemblies and drum being relatively positioned so that said expanding preform will come into sliding contact with said crowned surface as said surface freely rotates with said preform, after a selected degree of initial expansion;

whereby a full expansion of said preform is achieved a fully expanded and shaped honeycomb sheet corresponding to said crowned surface results.

2. The apparatus according to claim 1 wherein said first arm assembly comprises:

a pair of fixed brackets located adjacent to the edges of said drum surface;

a first bar extending between said brackets substantially parallel to the drum axis; and a plurality of spaced connection means along said first bar each adapted to connect to said first outside strip of said preform.

3. The apparatus according to claim 2 wherein said connection means comprises a plurality of spaced filaments that are threaded between preform strips near the edge thereof and around said first bar to flexibly secure said preform to said bar.

4. The apparatus according to claim 1 wherein said second arm assembly comprises:

a pair of elongated plates substantially parallel to the drum ends;

drum axis bearing means at first end of each of said plates to allow said plates to pivot about said drum axis relative to said free rotation of said drum;

the second plates ends extending beyond the drum surface and includes means for removably holding a second bar;

said second bar extending across the drum surface between said second plate ends and spaced a selected distance from the drum surface; and a plurality of spaced connections means along said bar, each adapted to connect to said outside strip of a honeycomb preform.

5. The apparatus according to claim 4 wherein said connection means comprises a plurality of spaced filaments that are threaded between preform strips near the edge thereof and around said second bar to flexibly secure said preform to said bar.

6. The apparatus according to claim 1 wherein said arms are positioned relative to said drum surface such that said expanding preform will come into initial contact with said drum surface after about 50 to 80% of full expansion has occurred.

7. The apparatus according to claim 1 wherein said crowned surface is a surface of revolution.

8. The apparatus according to claim 1 wherein the surface material of said drum is selected from the group consisting of metal and fiber reinforced organic matrix composites.

9. The apparatus according to claim 1 wherein said expanding preform comes into contact with said crowned surface less than about 30% of the circumference of the drum.

10. The method of expanding and contouring honeycomb preforms into compound curved honeycomb sheets which comprise:

providing a honeycomb preform comprising a plurality of contiguous strips bonded together in selected areas whereby a honeycomb sheet can be formed by moving outside strips away form each other;

securing the outside strips along a first edge of said preform to a first arm assembly;

securing the outside strips along the second edge of said preform to a second arm assembly;

moving at least one of said arm assemblies away from the other to expand said preform to a selected fraction of the full expansion necessary to provide hexagonal cells;

bringing the resulting partially expanded preform into sliding contact with a freely rotatable crowned forming surface; and continuing movement of at least one arm assembly away from the other to expand said preform to said full expansion while gradually increasing the area of contact between said preform and said forming surface the expansion of said preform during said movement of said at least one arm assembly causing said freely rotatable crown surface to slide;

whereby a compound curved honeycomb sheet is produced with substantially no damage to honeycomb cells.

11. The method according to claim 10 including fixedly positioning one of said arms adjacent to said freely rotatable crowned forming surface and pivotably mounting the second arm on a shaft about which said freely rotatable crowned forming surface rotates and said second arm is moved away from said first arm by pivoting said second arm about said shaft.

12. The method according to claim 10 wherein said preform is secured to each of said arm assemblies by threading a plurality of wires through said preform between strips along each edge and around a bar fastened to each adjacent arm assembly.

13. The method according to claim 10 including positioning said arms relative to said drum surface such that said expanding preform will come into contact with said drum surface after about 50 to 80% of full honeycomb expansion has occurred.

14. The method according to claim 10 wherein said expanding preform comes into full contact with the drum surface after from about 79 to 90% of full expansion and remaining expansion .is accomplished with the preform in full contact with the drum surface.

15. The method according to claim 10 wherein said expanding preform comes in contact with said drum surface less than about 30% of the circumference of the drum.

* * * * *